US005979596A

United States Patent [19]

Baker

[11] Patent Number: 5,979,596

[45] Date of Patent: Nov. 9, 1999

[54] AUTOMATIC COMPRESSION BRAKE MUFFLER

[76] Inventor: Gary A. Baker, 12215 5th Ave. SE., Everett, Wash. 98208

[21] Appl. No.: 09/121,330

[22] Filed: Jul. 23, 1998

[51] Int. Cl.[6] ..... F01N 1/00

[52] U.S. Cl. ..... 181/253; 181/254

[58] Field of Search ..... 181/237, 254, 181/249, 253, 241, 227, 228; 123/323; 188/273

[56] References Cited

U.S. PATENT DOCUMENTS 2,072,372 3/1937 Kingsley ..... 181/254

5,435,347 7/1995 Gullingham ..... 181/237

*Primary Examiner*—Khanh Dang

[57] ABSTRACT

An automatic compression brake muffler is provided including a muffler pipe. An auxiliary pipe is connected to the muffler pipe and defines passages which are offset from the muffler pipe. Next provided is a mechanical valve having an open orientation for allowing the passage of air through the entire muffler pipe and a closed orientation for precluding the passage of air through the entire muffler pipe and further forcing air through the auxiliary pipe. Finally, a mechanism is included for transferring the mechanical valve to the closed orientation only when a compression brake is actuated.

6 Claims, 2 Drawing Sheets

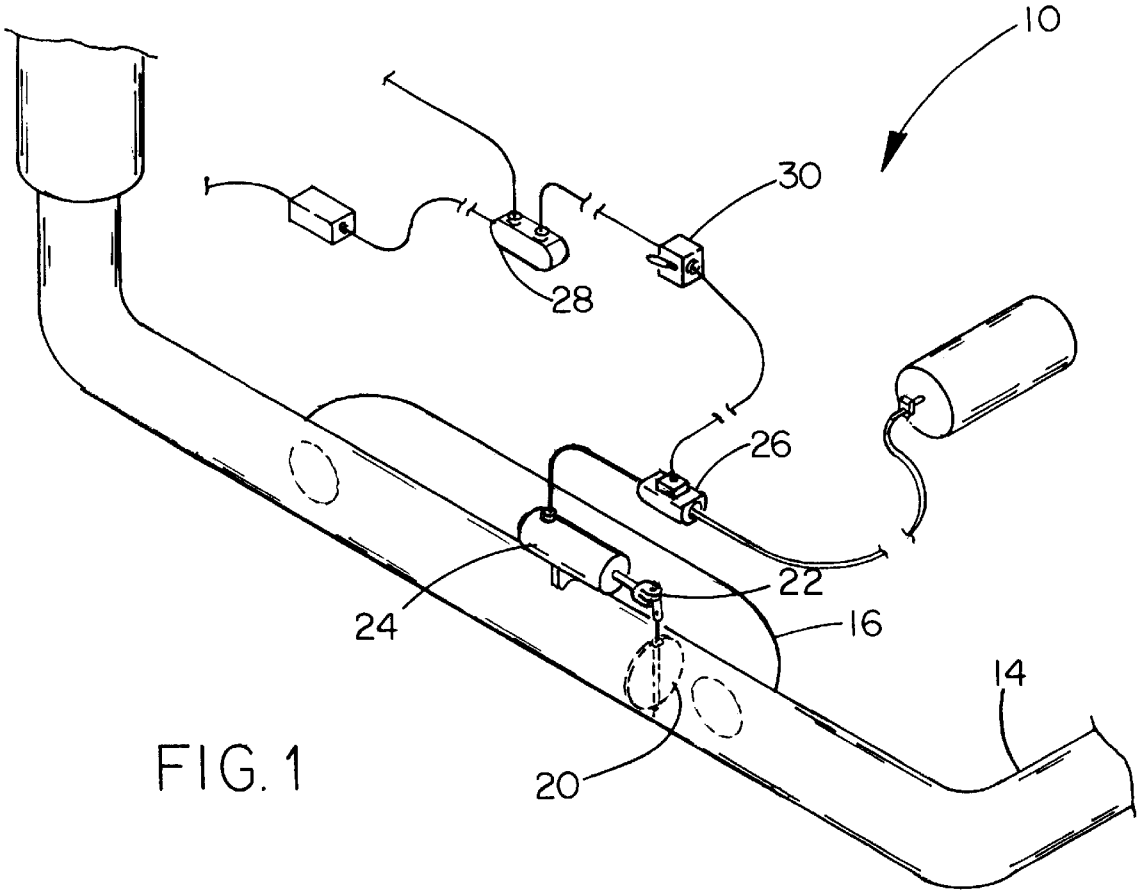
FIG. 1
FIG. 1A
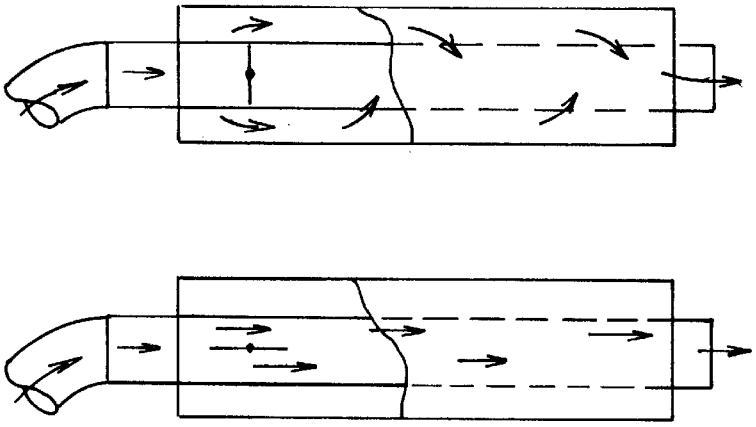
FIG. 1B

AUTOMATIC COMPRESSION BRAKE MUFFLER

BACKGROUND OF THE INVENTION

1. Field of the Invention

The present invention relates to muffler systems and more particularly pertains to a new automatic compression brake muffler for abating noise associated with compression brakes thus allowing associated vehicles to be used in noise sensitive areas.

2. Description of the Prior Art

The use of muffler systems is known in the prior art. More specifically, muffler systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art muffler systems include U.S. Pat. No. 5,208,429; U.S. Pat. No. 4,904,165; U.S. Pat. No. 5,207,564; U.S. Pat. No. 4,404,799; U.S. Pat. No. 5,288,211; and U.S. Patent Des. No. 267,968.

In these respects, the automatic compression brake muffler according to the present invention substantially departs from the conventional concepts and designs of the prior art, and in so doing provides an apparatus primarily developed for the purpose of abating noise associated with compression brakes thus allowing associated vehicles to be used in noise sensitive areas.

SUMMARY OF THE INVENTION

In view of the foregoing disadvantages inherent in the known types of muffler systems now present in the prior art, the present invention provides a new automatic compression brake muffler construction wherein the same can be utilized for abating noise associated with compression brakes thus allowing associated vehicles to be used in noise sensitive areas.

The general purpose of the present invention, which will be described subsequently in greater detail, is to provide a new automatic compression brake muffler apparatus and method which has many of the advantages of the muffler systems mentioned heretofore and many novel features that result in a new automatic compression brake muffler which is not anticipated, rendered obvious, suggested, or even implied by any of the prior art muffler systems, either alone or in any combination thereof.

To attain this, the present invention generally comprises an elongated straight muffler pipe having a hollow cylindrical configuration with a pair of spaced circular bores formed therein. Such bores reside about parallel axes which in turn remain in perpendicular relationship with an axis associated with the muffler pipe. Note FIG. 1. Also included is a short straight auxiliary pipe having a hollow cylindrical configuration. Such auxiliary pipe is equipped with a pair of ends coupled to the circular bores of the muffler pipe. As such, an axis of the auxiliary pipe remains in parallel with the axis of the muffler pipe. Further, the auxiliary pipe is in communication with the muffler pipe during use. A butterfly valve is provided including a disk-shaped plate rotatably coupled within the muffler pipe between the circular bores thereof. During use, the plate has an open orientation with the plate residing in a plane coincident with the axis of the muffler pipe. The plate further has a closed orientation with the plate residing in a plane perpendicular with the axis of the muffler pipe. An arm is fixedly mounted at a first end to the plate at the axis about which it rotates. An air cylinder is mounted to an exterior of the muffler pipe and pivotally coupled to a second end of the arm for rotating the same to its open orientation only upon the receipt of pressured air from an associated air tank. Connected between the butterfly valve and the associated air tank is an electronic air valve. Such electronic air valve is adapted for allowing the passage of pressurized air to the butterfly only upon receipt of an activation signal. As shown in FIG. 1, a junction box is connected to a compression brake throttle switch. The junction box functions to generate the activation signal only upon the detection of the actuation of a compression brake. Finally, an activation switch is connected between the junction box and the electronic air valve. The activation switch is situated within a cab of the vehicle. The activation switch has a first orientation for precluding the transfer of the activation signal to the electronic air valve and a second orientation for allowing the transfer of the activation signal to the electronic air valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic compression brake muffler apparatus and method which has many of the advantages of the muffler systems mentioned heretofore and many novel features that result in a new automatic compression brake muffler which is not anticipated, rendered obvious, suggested, or even implied by any of the prior art muffler systems, either alone or in any combination thereof.

It is another object of the present invention to provide a new automatic compression brake muffler which may be easily and efficiently manufactured and marketed.

It is a further object of the present invention to provide a new automatic compression brake muffler which is of a durable and reliable construction.

An even further object of the present invention is to provide a new automatic compression brake muffler which is susceptible of a low cost of manufacture with regard to both materials and labor, and which accordingly is then susceptible of low prices of sale to the consuming public, thereby making such automatic compression brake muffler economically available to the buying public.

Still yet another object of the present invention is to provide a new automatic compression brake muffler which provides in the apparatuses and methods of the prior art some of the advantages thereof, while simultaneously overcoming some of the disadvantages normally associated therewith.

Still another object of the present invention is to provide a new automatic compression brake muffler for abating noise associated with compression brakes thus allowing associated vehicles to be used in noise sensitive areas.

Even still another object of the present invention is to provide a new automatic compression brake muffler that includes a muffler pipe. An auxiliary pipe is connected to the muffler pipe and defines passages which are offset from the muffler pipe. Next provided is a mechanical valve having an open orientation for allowing the passage of air through the entire muffler pipe and a closed orientation for precluding the passage of air through the entire muffler pipe and further forcing air through the auxiliary pipe. Finally, a mechanism is included for transferring the mechanical valve to the closed orientation only when a compression brake is actuated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new automatic compression brake muffler according to the present invention.

FIGS. 1A & 1B are cross-sectional views of an alternate embodiment.

DESCRIPTION OF THE PREFERRED EMBODIMENT

Figure 2:
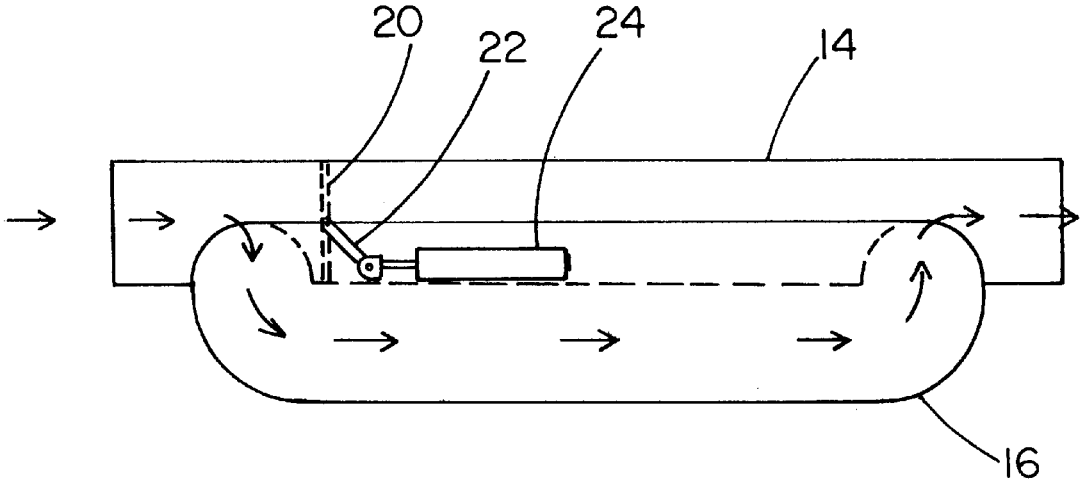
FIG. 2 is a top view of the present invention.

With reference now to the drawings, and in particular to FIGS. 1 through 4 thereof, a new automatic compression brake muffler embodying the principles and concepts of the present invention and generally designated by the reference numeral 10 will be described.

The present invention, designated as numeral 10, includes an elongated straight muffler pipe 14 having a hollow cylindrical configuration with a pair of spaced circular bores formed therein. Such bores reside about parallel axes which in turn remain in perpendicular relationship with an axis associated with the muffler pipe. Note FIG. 1.

Figure 3:
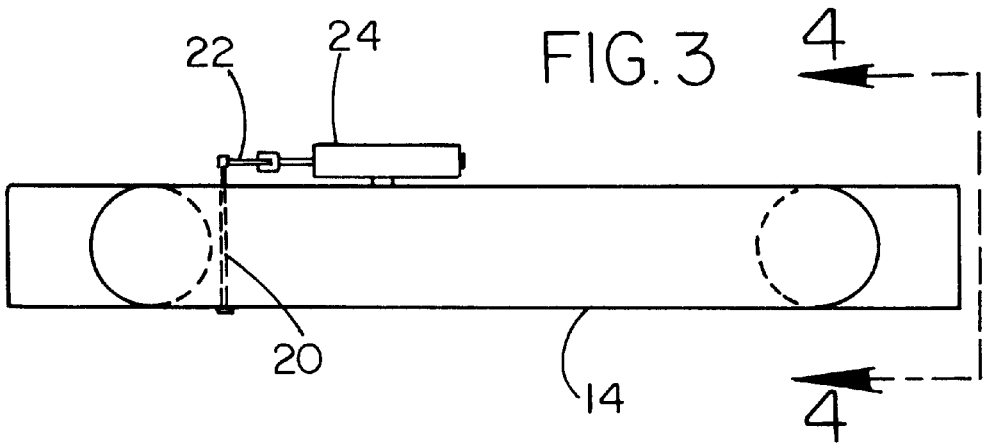
FIG. 3 is a side view of the present invention.
Figure 4:
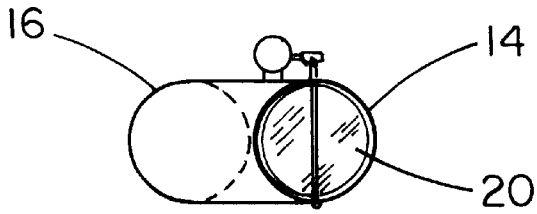
FIG. 4 is an end view of the present invention.

Also included is a short straight auxiliary pipe 16 having a hollow cylindrical configuration. Such auxiliary pipe is equipped with a pair of ends coupled to the circular bores of the muffler pipe. As such, an axis of the auxiliary pipe remains in parallel with the axis of the muffler pipe. Further, the auxiliary pipe is in communication with the muffler pipe during use. As shown in FIG. 3, a diameter of the auxiliary pipe is equal to that of the muffler pipe.

In an alternate embodiment, as shown in FIGS. 1A & 1B, the auxiliary pipe may be of a diameter twice that of the muffler pipe. Further, the pipe may be connected in concentric relationship therewith. It should be noted that, in the present embodiment, a plurality of apertures are formed in the muffler pipe which communicate with the auxiliary pipe.

A butterfly valve 20 is provided including a planar disk-shaped plate rotatably coupled within the muffler pipe between the circular bores thereof. During use, the plate has an open orientation with the plate residing in a plane coincident with the axis of the muffler pipe. The plate further has a closed orientation with the plate residing in a plane perpendicular with the axis of the muffler pipe. An arm 22 is fixedly mounted at a first end to the plate at the axis about which it rotates. An air cylinder 24 is mounted to an exterior of the muffler pipe and pivotally coupled to a second end of the arm for rotating the same to its open orientation only upon the receipt of pressured air from an associated air tank. It should be understood that in alternate embodiments, the air cylinder may be replaced with equivalent electric cylinders or the like.

Connected between the butterfly valve and the associated air tank is an electronic air valve 26. Such electronic air valve is adapted for allowing the passage of pressurized air to the butterfly only upon receipt of an activation signal.

As show in FIG. 1, a junction box 28 is connected to a compression brake throttle switch. The junction box functions to generate the activation signal only upon the actuation of a compression brake.

Finally, an activation toggle switch 30 is connected between the junction box and the electronic air valve. The activation switch is situated within a cab of the vehicle and accessible to a driver. The activation switch has a first orientation for precluding the transfer of the activation signal to the electronic air valve and a second orientation for allowing the transfer of the activation signal to the electronic air valve. The activation switch thus functions to allow a user to utilize the present invention only in places where the noise associated with compression brakes is prohibited.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic compression brake muffler comprising, in combination:

an elongated straight muffler pipe having a hollow cylindrical configuration with a pair of spaced circular bores formed therein that reside about parallel axes which in turn remain in perpendicular relationship with an axis associated with the muffler pipe;

a short straight auxiliary pipe having a hollow cylindrical configuration with a pair of ends coupled to the circular bores of the muffler pipe such that an axis thereof remains in parallel with the axis of the muffler pipe and the auxiliary pipe is in communication with the muffler pipe;

a butterfly valve including a disk-shaped plate rotatably coupled within the muffler pipe between the circular bores thereof with the plate having an open orientation with the plate residing in a plane coincident with the axis of the muffler pipe and a closed orientation with the plate residing in a plane perpendicular with the axis of the muffler pipe, an arm fixedly mounted at a first end to the plate at the axis about which it rotates, and an air cylinder mounted to an exterior of the muffler pipe and pivotally coupled to the arm for rotating the same to its open orientation only upon the receipt of pressured air from an associated air tank;

an electronic air valve connected between the butterfly valve and the associated air tank for allowing the passage of pressurized air to the butterfly only upon receipt of an activation signal;

a junction box connected to a compression brake throttle switch for generating the activation signal only upon the detection of the actuation of a compression brake; and an activation switch connected between the junction box and the electronic air valve and situated within a cab of the vehicle, the activation switch having a first orientation for precluding the transfer of the activation signal to the electronic air valve and a second orientation for allowing the transfer of the activation signal to the electronic air valve.

2. An automatic compression brake muffler comprising:

a muffler pipe;

an auxiliary pipe connected to the muffler pipe which defines passages which are offset from the muffler pipe;

a mechanical valve having an open orientation for allowing the passage of air through the entire muffler pipe and a closed orientation for precluding the passage of air through the entire muffler pipe and further forcing air through the auxiliary pipe, an arm fixedly mounted to the mechanical valve, an air cylinder mounted to an exterior of the muffler pipe, the air cylinder being pivotally coupled to the arm for urging said mechanical valve into said open orientation only upon the receipt of pressured air from an associated air tank;

an electronic air valve connected between the mechanical valve and the associated air tank for allowing the passage of pressurized air to the mechanical valve only upon receipt of an activation signal; and a junction box being coupled between said air valve and a compression brake for generating said activation signal upon actuation of said compression brake.

3. An automatic compression brake muffler as set forth in claim 2 wherein the mechanical valve includes a butterfly valve.

4. An automatic compression brake muffler as set forth in claim 2, further comprising:

an activation switch operationally coupled to said junction box, said activation switch being situated within a cab of the vehicle, the activation switch having a first orientation for precluding the transfer of the mechanical valve to the closed orientation and a second orientation for allowing the transfer of the mechanical valve to the closed orientation.

5. An automatic compression brake muffler as set forth in claim 2 wherein the auxiliary pipe is situated about an axis in parallel relationship with the muffler pipe.

6. An automatic compression brake muffler as set forth in claim 2 wherein the auxiliary pipe is situated about an axis in concentric relationship with the muffler pipe.

* * * * *